United States Patent [19]

Reid et al.

[11] Patent Number: 4,915,205

[45] Date of Patent: Apr. 10, 1990

[54] APPARATUS FOR DISPENSING AND RECEIVING RENTED ARTICLES

[75] Inventors: John N. Reid, Great Wakerling; Keith B. Glanvill, West Mersea; Peter R. Hodgetts, Colchester, all of England

[73] Assignee: Sovereign Technical Services Ltd., Onchan, United Kingdom

[21] Appl. No.: 42,949

[22] PCT Filed: Aug. 4, 1986

[86] PCT No.: PCT/GB86/00468

§ 371 Date: Jun. 5, 1987

§ 102(e) Date: Jun. 5, 1987

[87] PCT Pub. No.: WO87/00948

PCT Pub. Date: Feb. 12, 1987

[30] Foreign Application Priority Data

Aug. 6, 1985 [GB] United Kingdom ..... 8519701

[51] Int. Cl.[4] ..... G07F 7/06; G07F 7/10

[52] U.S. Cl. ..... 194/205; 221/76; 221/119; 221/306; 235/381; 235/382; 340/825.35

[58] Field of Search ..... 194/205, 210, 214; 221/76, 79, 80, 81, 88, 91, 92, 119, 120, 122, 130, 132, 133, 306, 121, DIG. 1; 414/273; 235/380, 381, 382, 382.5; 312/35, 117, 125, 97.1; 340/825.34, 825.35

[56] References Cited

U.S. PATENT DOCUMENTS

| | | | |
|---|---|---|---|
| 2,532,364 | 12/1950 | Johnson | 221/DIG. 1 |
| 3,857,018 | 12/1974 | Stark et al. | 235/382 |
| 4,300,042 | 11/1981 | Oldenkamp et al. | 340/825.35 X |
| 4,458,802 | 7/1984 | Maciver et al. | 221/81 X |
| 4,519,522 | 5/1985 | McElwee | 221/79 X |
| 4,668,150 | 5/1987 | Blumberg | 221/88 X |

FOREIGN PATENT DOCUMENTS

| | | | |
|---|---|---|---|
| 0060643 | 9/1982 | European Pat. Off. . | |
| 3315724 | 10/1984 | Fed. Rep. of Germany . | |
| 3336619 | 4/1985 | Fed. Rep. of Germany . | |
| 2549624 | 1/1985 | France . | |
| 2559599 | 8/1985 | France | 194/210 |
| 2563985 | 11/1985 | France . | |
| 0068642 | 1/1983 | United Kingdom . | |
| 2143662 | 2/1985 | United Kingdom . | |

*Primary Examiner*—F. J. Bartuska
*Assistant Examiner*—Edward S. Ammeen
*Attorney, Agent, or Firm*—Dellett, Smith-Hill and Bedell

[57] ABSTRACT

Machine for automatic rental of video cassettes. Cassettes are stored in a drum like magazine (32) and are made available at a dispensing slot (20, 22) after a user has identified himself by introducing a personal into a slot (12) and entered a unique personal code number on a keyboard (16) which the user also employs to enter the selection from the available video cassettes. On returning the cassette, the user again identifies himself and the machine verifies by reading a bar code that the hired film has been returned.

21 Claims, 1 Drawing Sheet

APPARATUS FOR DISPENSING AND RECEIVING RENTED ARTICLES

Figure 2:
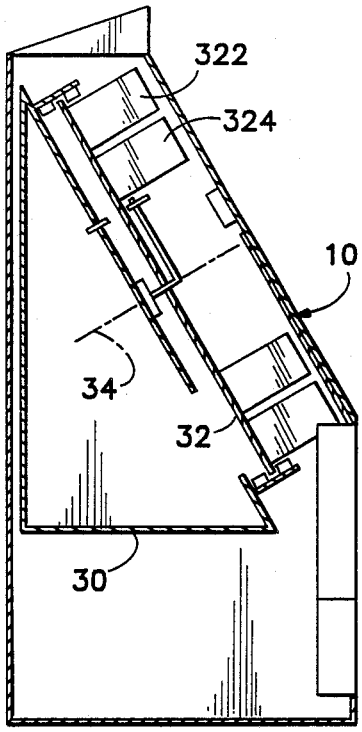

The present invention relates to automatic dispensing apparatus and is particularly concerned with apparatus for automatic renting, as opposed to vending.

Automatic vending machines are of course already known and widely used for automatic dispensing of numerous consumable products. Their contribution in increasing sales and reducing business overheads is also well appreciated. However, the known machines are all vending machines, accepting money or tokens in exchange for goods, but having no provision for receiving returned goods. As a result they cannot be used for dispensing articles which are available only for rental.

Video cassettes and discs, which have recently become very popular, have created a large market for renting rather than selling. The reason for this is that each cassette is relatively expensive and uneconomical to purchase as most viewers will seldom wish to see a film more than once. The renting of such cassettes, on the other hand is a potentially profitable business as each cassette can earn several times its purchase cost.

A difficulty in operating such a rental business has been the need to work unsociable hours since viewers will often wish to rent a cassette and return it outside normal working hours. There is therefore a clear demand for an automated renting machine but despite this it is believed that no suitable machine for this purpose is available. Of course, with rental it does not suffice to dispense, it is important to record the whereabouts of each article which has been dispensed for rental.

Accordingly, the present invention seeks to provide an apparatus capable of automatically dispensing articles for rental and accepting returned articles.

According to the present invention, there is provided apparatus capable of dispensing articles for rental and accepting returned articles, comprising means for enabling a user to enter a unique identification code, means for verifying the code entered to inhibit dispensing to unauthorised users, means for enabling payment for rental to be made, means for enabling a user to select from amongst the articles available for rental, a magazine having a plurality of compartments each for receiving a respective one of the articles for rental, means for moving the magazine relative to a dispensing aperture to align with the dispensing aperture the magazine compartment containing the selected article, and means for recording data indicating the identity of the user and the selected article, the apparatus further comprising means for reading from the recorded data the article previously hired to an identified user, means for moving the magazine to align with the dispensing aperture the empty compartment for containing the article previously hired to the identified user, means operative after insertion of the article into the compartment by the user to read a code on the article identifying the returned article and means for recording the return of the rented article when the article code corresponds with that read from the recorded data.

It will be noted that in addition to the financial transaction carried out by the apparatus, it is essential that the user should identify himself. In this respect, the apparatus differs from conventional vending machines. Furthermore, a record is maintained of the identity of the user to whom each article is rented so that the article may be traced if not properly returned.

In the preferred embodiment of the invention, each user may only rent one article at a time and when the identity code is entered, it may be immediately determined if an article is being rented or returned by ascertaining if an article has already been rented to that user. It is possible, alternatively, to allow each user to rent several articles, whereupon means may be provided to enable the user to select the mode of operation for dispensing or accepting a returned article and in this case the user must also identify the article being returned.

The means for entering a unique identification code may comprise an encoded card issued to authorised users, means for reading data recorded on the card and a keyboard for manual entry of a codeword, access to the machine being possible only when the codeword corresponds with the data recorded on the card.

The money transaction may be performed in any of several known ways. For example, a coin freed mechanism may be provided, or tokens may be issued from a counter. It is still further possible to employ recorded cards, such as used by some telephones, which are prepurchased and allow a predetermined amount to be spent before being made unusable.

The recording of data is preferably carried out on a programmable micro-computer within the dispensing apparatus, It will be appreciated also that many of the functions of the machine can be performed under the control of the micro-computer.

In the dispensing of video cassettes in particular, there is encountered the problem that certain films can only legally be rented to adults. It is possible in the preferred embodiment of the invention to include a code on a card issued to a minor to inhibit dispensing of certain categories of films, the latter being indicated by the code identifying the cassette.

Rental is usually carried out on a time basis and it is preferred that the apparatus should include a clock and that the data recorded should indicate the time of rental and the time of return.

It is also desirable that the apparatus include a display unit for conveying information to the user. This information may include prompts and may also display available titles or the price of each selection. If the pricing is effected under software control and there is present a real time clock, then the pricing may be varied with the day of the week, for example, to encourage rental during otherwise slack periods.

If the data storage is effected exclusively in computer memory, there is a danger that data may be lost in the event of power failure. It is therefore preferred that the apparatus should include means for permanently recording at least some of the data, such means being a printer or a magnetic recorder such as a cassette, floppy disc or diskette.

The magazine for carrying the articles, that is to say the video cassettes, is preferably constructed as a cylindrical drum with a plurality of radially extending compartments for the individual cassettes. This construction is particularly advantageous because it enables simple accurate alignment of the compartments with the dispensing aperture in that the drum or preferably the motor driving the drum may be fitted with a shaft encoder producing pulses as the drum rotates. The pulses can once again be analysed by the computer to determine the cassette compartment aligned with the dispensing aperture.

The drum preferably has two radially spaced rows of compartments, in order to make better use of the space available within the machine and the dispensing aperture is preferably constructed as two separate apertures each controlled by a shutter.

It is advantageous to form the apertures in line with one another and to employ as a shutter a sector plate pivotable between three position, both apertures being closed in one position, and a respective one of the apertures being open in each of the other two positions. In this manner a single actuator may serve to control the opening and closing of both the apertures.

In order to rotate a large drum using a small motor, it is necessary to provide a suitable transmission train. If a drive belt is employed then there is a risk of slipping which could lead to misalignment of the apertures with the dispensing apertures. Cogs are more reliable but the cost may prove excessive.

In order to mitigate this problem, it is preferred to secure to the outer circumference of the drum a toothed belt of the same diameter, the teeth pointing radially outwards. The belt may be secured, for example, by rivets. The teeth of the belt can now be directly engaged by teeth on a cog driven by the motor. This construction provides an inexpensive alternative to the use of a toothed wheel on the drum and the performance of the belt has, surprisingly, been found not to be adversely affected by the fact that it is inverted.

The code on the articles is preferably a bar code. To read a bar code, it is necessary to be able to scan the bar code optically. The use of a drum enables the reading of the bar codes in a simple manner in that the drum may drive the bar code at constant speed past a stationary reader. It is necessary to allow enough distance for the drum to reach a steady speed before reading is effected.

As an alternative to the use of a light pen, the bar code may be imaged onto a camera so that its image may be scanned electronically rather than mechanically. The camera may conveniently comprise a charge coupled device.

Figure 1:
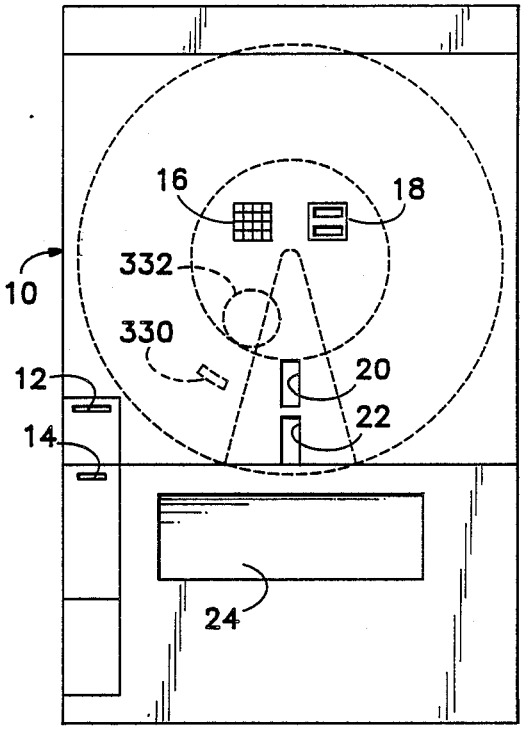
Figure 3:
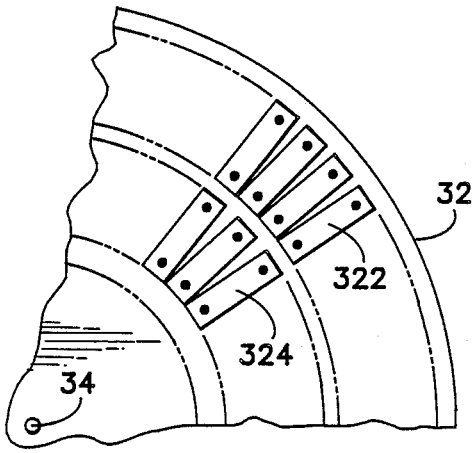
Figure 4:
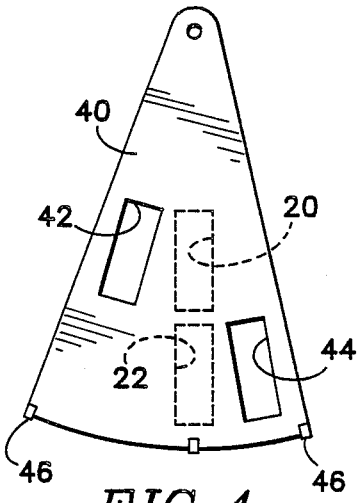

The invention will now be described further, by way of example, with reference to the accompanying drawings, in which:

FIG. 1 is a front view of a dispensing machine of the invention designed especially for the rental of video cassettes, FIG. 2 is a vertical section through the machine shown in FIG. 1, FIG. 3 shows a partial plan view of the magazine drum used in the embodiment of FIGS. 1 and 2, and FIG. 4 shows schematically the shutters associated with the dispensing apertures.

The machine comprises an outer casing 10 resembling, for example, that of a conventional drinks dispensing machine. To the left, on the front of the casing, there is present a slot 12 for receiving an encoded card and a second slot 14 for receiving coins.

A keyboard 16 is arranged near eye level, adjacent a display unit 18 which may be an LCD or an LED display. The keyboard and display provide the means by which communication can take place between the user and the micro-computer within the machine. The latter is not shown in the drawings nor is a printer driven by the micro-computer but both these are conventional items and need not be described in the context of the present application.

Beneath the display 18 and keyboard 16, there are arranged two vertically spaced shuttered apertures 20 and 22 from which video cassettes are dispensed in the manner to be described in more detail below.

Also illustrated in FIG. 1 is a recess 24 for receiving a catalogue listing the available films but this may instead be a display board such as currently in use on juke boxes.

Referring now to the section shown in FIG. 2, there is disposed behind the front panel of the casing 10 a subframe 30 carrying a magazine drum 32 with its axis 34 inclined to the horizontal. Because of this inclination any cassettes carried by the drum 32 tend to fall towards the back of the drum 32.

The drum 32 is composed, as shown in FIG. 3, of individual cassette containers 322 and 324 arranged side by side on two diameters, each container being large enough to contain a cassette while held within a transparent case. The cassettes are dispensed in cases, and the latter are transparent to enable a code written on the cassette itself to be read. As an alternative the cases for the cassettes may have only a transparent window aligned with the bar code on the cassettes or they may be provided with a cut-out at such location.

Between the two rows of containers 322, 324 there are disposed bar code readers 330 these being arranged on a radius circumferentially staggered from the dispensing apertures and being shown in dotted lines in FIG. 1.

The drum 32 is journalled about its outer circumference on the subframe 30 and has a hub engaged by an electric motor and gearbox 332 shown in dotted lines in FIG. 1 but not shown in the section of FIG. 2. The hub has about its outer circumference, not shown, a toothed belt which is turned inside out and secured to the hub by means of rivets. The hub thus acts as a large gear wheel and engages directly a cog on the output of motor driven gearbox. The motor shaft is fitted with a shaft encoder which is connected to the micro-computer and the motor current is in turn controlled by the output of the micro-computer.

The identification card to be inserted in the slot 12 may be magnetically encoded. However, because a bar code reader is already present to identify the cassettes and the decoding program is already present in the computer, it is preferred that the user cards should also carry optical bar codes. The coin freed mechanism may be conventional and need not therefore be described in detail.

The apertures for dispensing the cassettes are opened and closed by a shutter shown in FIG. 4. The shutter is in the form of a sector plate 40 having apertures 42 and 44 of the same size as the dispensing apertures 20 and 22. The apertures 42, 44 in the sector plate 40 may be selectively aligned with the respective apertures 20 and 22 and 44 in the front plate of the machine by pivoting the sector plate between three click stop positions determined by stops or ball catches 46. It can readily be seen that the apertures are either both closed or one may be opened at one time by pivoting the sector plate to the left or right of its centre position.

The sector plate 40 is sufficiently strong to be tamper proof and is preferably driven by a second motor acting through a worm gear. Such a drive mechanism provides high torque and can also act as a brake preventing forcing of the sector plate. However, because of the very high torque there is a risk of damage being caused to anything trapped in the apertures 20, 22 while the motor is energised. It is therefore preferred that a further trap door or flap be provided on each aperture 20, 22 associated with a switch which is only closed when the flap covers the aperture entirely. This safety interlock can ensure that the user's fingers are away from the danger zone before the motor can be energised. The flap may be spring or gravity biassed into a closed position.

The electronic controls of the machine can be implemented by means of a specially designed circuit but it is more convenient to employ a micro-computer, which are available inexpensively, to perform all the logic controls. The computer can be programmed in machine code or a suitable computer language and detailed description of the program is not therefore deemed to be required and clear to a person skilled in the art of programming from the mode of operation of the machine which will now be described and from which it is readily possible to construct a flow chart for designing the program.

In the description that now follows, it will be assumed that each authorised user is issued previously with an identification card and identification code and that any user can only borrow one cassette at a time.

After each dispensing cycle, the drum is returned to a rest or datum position which can be identified by a position encoder on the drum or on the shaft of the motor or gearbox driving the drum 32. As the drum rotates, the pulses emitted by the shaft encoder are counted and from this the angular position of the drum at any moment in time can be determined with accuracy. The return to a datum position avoids the possibility of developing a cumulative error.

With the drum in the datum position, the next user is permitted to enter his identification card into slot 12 to commence a new dispensing cycle. A switch within the card reader, which is itself conventional and need not be described in detail, signals to the computer that a card has been inserted. The computer now controls the card reader to read the code from the card and records the code in its volatile memory.

Before any access is allowed, it is necessary for the user to enter through the keyboard 16 his personal identification code known only to him and which matches the code read from the card in the slot 12. If the correct code is entered then the cycle continues, otherwise the user will be asked to re-enter his personal identification code. If several attempts are unsuccessful, it is possible for the card to be confiscated eliminating the possibility of a code of a stolen card being derived from trial and error.

Once the user has correctly identified himself, the computer searches though its memory to establish if the user has already borrowed a cassette. If not, it is assumed that the machine is to operate in a dispensing mode. However, as any user may only borrow one cassette at a time, if he already has a cassette on hire then it is assumed that he is returning it and accordingly the machine operates in a receiving mode. Each of these modes will now be considered separately.

Assuming that no cassette is on hire to the user then the user is asked to make his selection of cassette through the keyboard 16. The memory of the computer stores information on all available cassettes and can indicate to the user immediately if the cassette is already on hire. If so, the user may either make a further selection or abort, his card being returned to him in the latter case.

If the cassette requested is available, then the next step is to prompt the user with the amount required to be placed in the coin freed mechanism 14. If the incorrect amount is placed in the machine it can be refunded or change given but no cassette can be dispensed until the correct payment has been made into the machine. It is mentioned here that on occasions a dispensing cycle can be commenced but cannot be completed, such as if the user finds he has insufficient change. To prevent the machine becoming ineffective, the computer contains a real time clock and a cycle can be automatically terminated if the transaction is not completed with a given time. At the end of such time, the card can either be returned or retained by the card reader.

If selection of an available cassette has been made and the correct payment made, the computer, knowing the container 322, 324 of the drum allocated for that cassette, energises the drum motor until the appropriate container is aligned with one or other of the two apertures 20, 22. The computer constantly compares the count from the shaft encoder with the desired count and stops the drum motor 332 when the aligned position is reached. The shutter motor is then operated to open the appropriate aperture 20, 22 and at this point the user may remove the cassette from the container.

After removal of the cassette, the container should be empty and if desired this can now be verified by driving the drum 32 until the container from which the cassette has been removed reaches the bar code readers 330. If a bar code is successfully read it may either be that the cassette has not been withdrawn for some reason or that another incorrect cassette has been erroneously put in its place. In either event the drum will be returned to re-align the container 322, 324 with the dispensing aperture and user will be asked to remove the cassette.

Once the container has been found as expected to be empty, the drum is returned to its datum position and the user's card will be returned to him by the card reader.

The computer now updates its memory to indicate that the cassette is out on hire, the code of the user in possession of the cassette, the time of the rental and if desired the amount paid. This information is also preferably printed out on a printer within the machine or transferred to some other non-volatile memory such as a magnetic recording medium.

It is possible that the code of the user may serve to indicate that the user is a minor not eligible to hire certain categories of cassette. In this case, the computer may indicate that the selection is not available in the same way as if it were on hire at the time of the request. The categories of the cassettes can of course also be indicated by their bar codes.

Assuming now that the cassette previously hired is to be returned by the user. After inserting his card and entering his identification code, the computer can search its memory to establish that not only is there a cassette out on hire to that user but also which cassette and when it was hired out. If the return is overdue, it is possible to make a further request for payment or a record may be made of the lateness so that persistent offenders may be warned.

The computer now knowing the container to which the cassette is to be returned rotates the drum from its datum position and on reaching the desired position opens the shutter 40 so that the cassette may be replaced in its proper position. Because of the slope of the containers, the cassette will slide to the back of the container. After closing of the safety interlock flap, the shutter closes and the drum is rotated until the returned cassette passes by the bar code readers 330. If the incorrect cassette, or an empty cassette case, has been returned the drum returns to the correct position and the user is again asked to insert the correct cassette. Failure to return the correct cassette after several attempts would result in the user's card being confiscated.

If the correct cassette is identified, the card user's card is returned to him, the drum is returned to the datum position and the computer records are updated both in memory and on the printer to indicate that the cassette just returned is now again available for hire and that the user no longer has a cassette on hire.

It is alternatively possible to ask if the user wishes to rent another cassette before the card is returned in order to save the user having to repeat the entire procedure of personal identification.

Because all the rental particulars are available on computer, it is possible to produce management information indicate the most popular cassettes and other trends such as slack periods etc. The operator may then select his stock of cassettes more frequently to maximise returns. The operator may also choose to vary his pricing policy, offering discounts during slack periods. The latter is made possible because of the presence of a real time clock in the machine and the facility of altering the rental charge under software control.

We claim:

1. Apparatus capable of dispensing articles for rental and accepting returned articles, comprising:

means for enabling a user to enter a unique identification code, means for verifying the code entered to inhibit dispensing to unauthorized users, means for enabling payment for rental to be made, means for enabling a user to select from amongst the articles available for rental, a magazine having a plurality of compartments each for receiving a respective one of the articles for rental, the magazine being constructed as a cylindrical drum with two radially spaced rows of radially extending compartments for the individual articles, means defining two separate dispensing apertures formed in line with one another, a sector shaped plate for controlling the dispensing apertures, the sector shaped plate being formed with offset apertures and being pivotable between three positions, both apertures being closed in one position, and a respective one of the apertures being open in each of the other two positions, means for moving the magazine relative to the dispensing apertures to align with a dispensing aperture the magazine compartment containing the selected article, and means for recording data indicating the identity of the user and the selected article, the apparatus further comprising:

means for reading from the recorded data the article previously hired to an identified user, means for moving the magazine to align with a dispensing aperture the empty compartment for containing the article previously hired to the identified user, means operative after insertion of the article into the compartment by the user to read a code on the article identifying the returned article, and means for recording the return of the rented article when the article code corresponds with that read from the recorded data.

2. Apparatus as claimed in claim 1, wherein the means for entering a unique identification code comprise an encoded card issued to authorized users, means for reading data recorded on the card and a keyboard for manual entry of a codeword, access to the apparatus being possible only when the codeword corresponds with the data recorded on the card.

3. Apparatus as claimed in claim 1, wherein the means for enabling payment to be made comprise a coin freed mechanism.

4. Apparatus as claimed in claim 1, wherein the recording of data is carried out on a programmable microcomputer within the dispensing apparatus.

5. Apparatus as claimed in claim 1, wherein a clock is provided for indicating the time of transactions.

6. Apparatus as claimed in claim 1, wherein the apparatus includes a display unit for conveying information to the user.

7. Apparatus as claimed in claim 1, further including means for permanently recording at least some of the data.

8. Apparatus as claimed in claim 1, wherein a toothed belt is secured to the outer circumference of the drum, the teeth of the belt pointing radially outwards and engaging directly with the teeth of a motor driven cog.

9. Apparatus as claimed in claim 1, wherein the codes on the articles are bar codes.

10. Apparatus according to claim 1, wherein the means for enabling a user to enter a unique identification code comprise an encoded card issued to an authorized user, means for reading data recorded on a user's card, and means for manual entry of a codeword, and the means for verifying the code comprise means for comparing the manually-entered codeword with data read from the card and inhibiting dispensing in the event that the codeword does not match data read from the card, and wherein there are at least two categories of article and the apparatus further comprises means for preventing articles of a predetermined category from being dispensed to an authorized user if the data read from the user's card includes a disabling code, while permitting articles of other categories to be dispensed to the authorized user.

11. Apparatus according to claim 1, wherein the magazine has a central axis which is inclined to the horizontal at an acute angle, and the means for moving the magazine relative to the dispensing apertures comprise means for rotating the magazine about its central axis.

12. Apparatus according to claim 11, wherein the dispensing apertures are disposed for allowing an article to be removed from or replaced in its compartment by moving the article through the respective aperture in a direction parallel to said central axis.

13. Apparatus capable of dispensing articles for rental and accepting returned articles, comprising:

means for enabling a user to enter a unique identification code, means for verifying the code entered to inhibit dispensing to unauthorized users, means for enabling payment for rental to be made, means for enabling a user to select from amongst the articles available for rental, a magazine having a plurality of compartments each for receiving a respective one of the articles for rental, the magazine being constructed as a cylindrical drum with at least first and second rows of compartments for the individual articles, the first row being at a first radial distance and the second row being at a second radial distance greater than the first radial distance, and the cylindrical drum having a central axis inclined to the horizontal at an acute angle, means for rotating the cylindrical drum about its central axis, whereby the magazine is moved relative to a dispensing aperture to align the magazine compartment containing the selected article with the dispensing aperture, which is positioned to allow an article to be removed from its compartment by moving the article through the aperture in a direction parallel to said central axis, means for recording data indicating the identity of the user and the selected article, means for reading from the recorded data the article previously hired to an identified user, means for moving the magazine to align with the dispensing aperture the empty compartment for containing the article previously hired to the identified user, whereby the article can be replaced in its compartment by moving the article through the aperture in a direction parallel to said central axis, means operative after insertion of the article into the compartment by the user to read a code on the article identifying the returned article, and means for recording the return of the rented article when the article code corresponds with the read from the recorded data.

14. Apparatus according to claim 13, wherein the means for enabling a user to enter a unique identification code comprise an encoded card issued to an authorized user, means for reading data recorded on a user's card, and means for manual entry of a codeword, and the means for verifying the code comprise means for comparing the manually-entered codeword with data read from the card and inhibiting dispensing in the event that the codeword does not match data read from the card.

15. Apparatus according to claim 14, wherein there are at least two categories of article and the apparatus further comprises means for preventing articles of one category from being dispensed to an authorized user if the data read from the user's card includes a disabling code while permitting articles of other categories to be dispensed to the authorized user.

16. Apparatus capable of dispensing articles for rental and accepting returned articles, comprising:

a magazine having a plurality of compartments each for receiving a respective one of the articles for rental, there being at least two categories of articles, and the magazine having a central axis inclined to the horizontal at an acute angle, an encoded card issued to an authorized user, means for reading data recorded on a user's card, means for manual entry of a codeword, means for comparing the manually-entered codeword with data read from the card and inhibiting dispensing in the event that the codeword does not match data read from the card, means for preventing articles of a predetermined category from being dispensed to an authorized user if the data read from the user's card includes a disabling code while permitting articles of other categories to be dispensed to the authorized user, means for enabling payment for rental to be made, means for enabling a user to select from amongst the articles available for rental, means for rotating the magazine about its central axis, whereby the magazine is moved relative to a dispensing aperture to align the magazine compartment containing the selected article with the dispensing aperture, which is positioned to allow an article to be removed from its compartment by moving the article through the aperture in a direction parallel to said central axis, means for recording data indicating the identity of the user and the selected article, means for reading from the recorded data the article previously hired to an identified user, means for moving the magazine to align with the dispensing aperture the empty compartment for containing the article previously hired to the identified user, whereby the article can be replaced in its compartment by moving the article through the aperture in a direction parallel to said central axis, means operative after insertion of the article into the compartment by the user to read a code on the article identifying the returned article, and means for recording the return of the rented article when the article code corresponds with that read from the recorded data.

17. Apparatus according to claim 16, wherein the articles are videotape cassettes and the disabling code is included in the cards of users who are younger than a predetermined age.

18. Apparatus capable of dispensing articles for rental and accepting returned articles, comprising:

a magazine having a plurality of compartments each for receiving a respective one of the articles for rental, there being at least two categories of articles, an encoded card issued to an authorized user, means for reading data recorded on a user's card, means for manual entry of a codeword, means for comparing the manually-entered codeword with data read from the card and inhibiting dispensing in the event that the codeword does not match data read from the card, means for preventing articles of a predetermined category from being dispensed to an authorized user if the data read from the user's card includes a disabling code while permitting articles of other categories to be dispensed to the authorized user, means for enabling payment for rental to be made, means for enabling a user to select from amongst the articles available for rental, means for moving the magazine relative to a dispensing aperture to align the magazine compartment containing the selected article with the dispensing aperture, which is constructed as two separate apertures formed in line with one another, a sector-shaped plate for controlling the two apertures, said sector-shaped plate being formed with offset apertures and being pivotable between three positions, both apertures being closed in one position and a respective one of the apertures being open in each of the other two positions, means for recording data indicating the identity of the user and the selected article, means for reading from the recorded data the article previously hired to an identified user, means for moving the magazine to align with the dispensing aperture the empty compartment for containing the article previously hired to the identified user, means operative after insertion of the article into the compartment by the user to read a code on the article identifying the returned article, and means for recording the return of the rented article when the article code corresponds with that read from the recorded data.

19. Apparatus according to claim 18, wherein the magazine has a central axis and the means for moving the magazine comprise means for rotating the magazine about its central axis.

20. Apparatus according to claim 19, wherein the magazine is disposed with its central axis inclined to the horizontal at an acute angle and the dispensing aperture is positioned to allow an article to be removed from, or replaced in, its compartment by moving the article through the aperture in a direction parallel to said central axis.

21. Apparatus according to claim 18, wherein the articles are videotape cassettes and the disabling code is included in the cards of users who are younger than a predetermined age.

* * * * *